United States Patent [19]

Rebel et al.

[11] 4,168,831

[45] Sep. 25, 1979

[54] DEVICE FOR DEPOSITING SHEETS IN SHEET-FED PRINTING PRESS

[75] Inventors: Herbert Rebel, Rodgau; Claus Simeth, Mulhheim, both of Fed. Rep. of Germany

[73] Assignee: Roland Offsetmaschinenfabrik Faber & Schleicher AG., Fed. Rep. of Germany

[21] Appl. No.: 910,366

[22] Filed: May 30, 1978

[30] Foreign Application Priority Data

Jun. 3, 1977 [DE] Fed. Rep. of Germany ..... 2725120

[51] Int. Cl.[2] ..... B65H 29/52

[52] U.S. Cl. ..... 271/177; 271/195

[58] Field of Search ..... 271/177, 188, 194, 195, 271/209, 211, 204

[56] References Cited

U.S. PATENT DOCUMENTS

| | | | |
|---|---|---|---|
| 1,193,627 | 8/1916 | Staude | 271/195 |
| 2,299,259 | 10/1942 | Sites | 271/177 |
| 2,769,495 | 11/1956 | Pomper et al. | 271/195 X |
| 3,159,398 | 12/1964 | Buccicone | 271/211 |

FOREIGN PATENT DOCUMENTS 111870 3/1975 Fed. Rep. of Germany .

*Primary Examiner*—Robert W. Saifer

*Attorney, Agent, or Firm*—Leydig, Voit, Osann, Mayer & Holt, Ltd.

[57] ABSTRACT

A device for use in a sheet delivery mechanism for a printing press for forcibly seating a sheet on a delivery pile notwithstanding the cushion of air below the sheet. The device includes a pair of tube assemblies arranged parallel to one another above the delivery pile symmetrically on opposite sides of the delivery center line, with each tube assembly consisting of inner and outer tubes in snugly telescoped relation, air being supplied to the inner tubes under pressure. The tubes within each assembly have registrable arcuately extensive ports. At least one of the tubes in each assembly is rotatable with respect to the other and has a drive connection with the press drive for rotation in respectively oppositely directions so that upon release of a sheet above the delivery pile the ports in each assembly are progressively moved into and then out of arcuate register to produce jets of air which sweep mutually outwardly from the sheet center line so that contact with the pile is made first at the center of the sheet followed by a flattening of the sheet against the pile progressively to the latter edges accompanied by prompt progressive squeezing of the cushion of air from under the lateral edges of the sheet. Preferably the inner tube of each assembly is rotatable and includes a plurality of ports in an arcuate series, with the outer tube having a free sector and being held relatively stationary but adjustable to vary the angle of sweep.

9 Claims, 18 Drawing Figures

FIG. 1
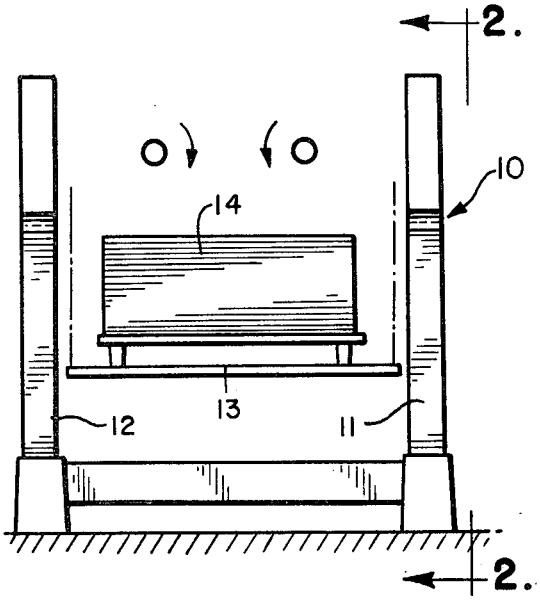
FIG. 2
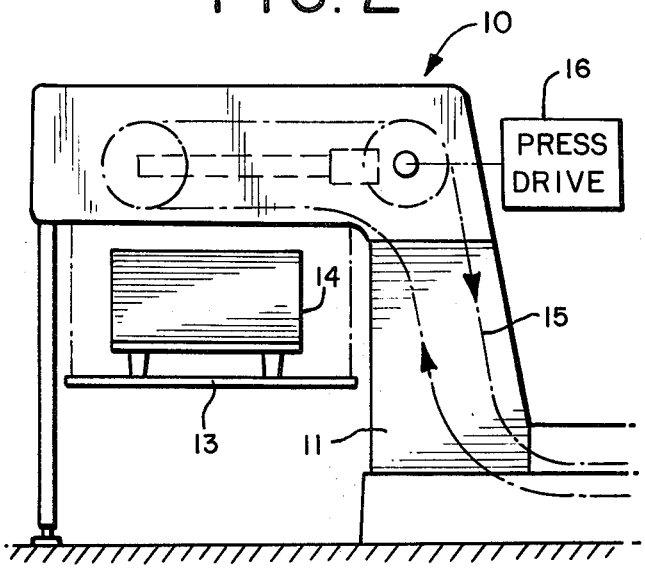
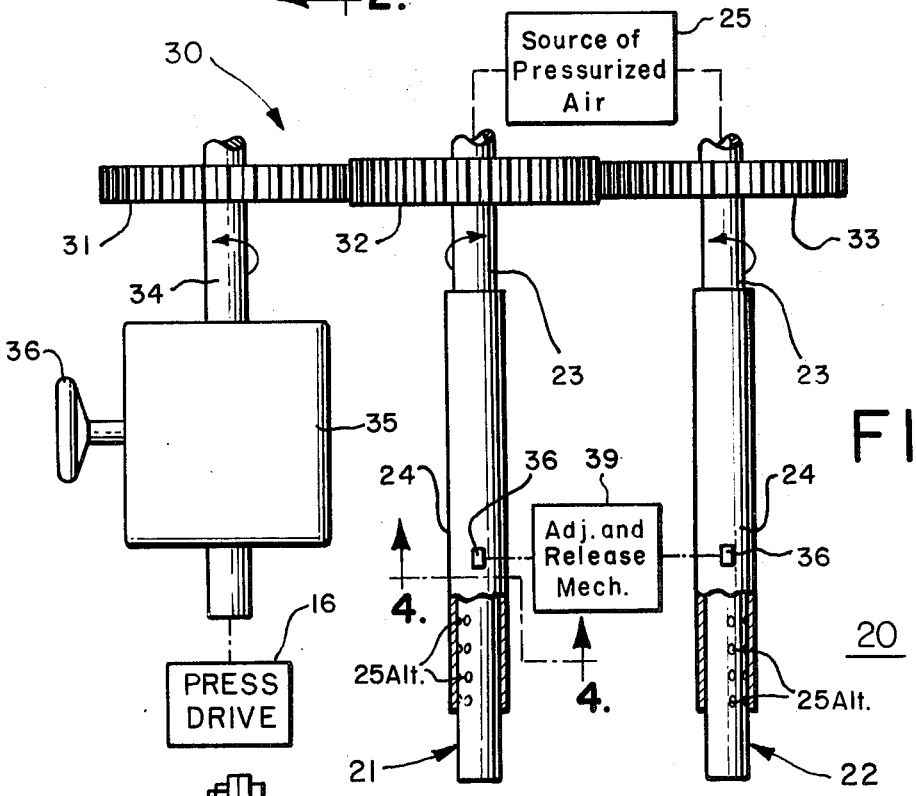
FIG. 3
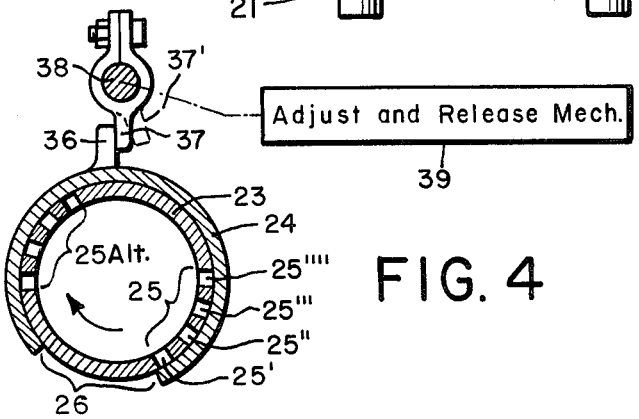
FIG. 4

FIG. 6
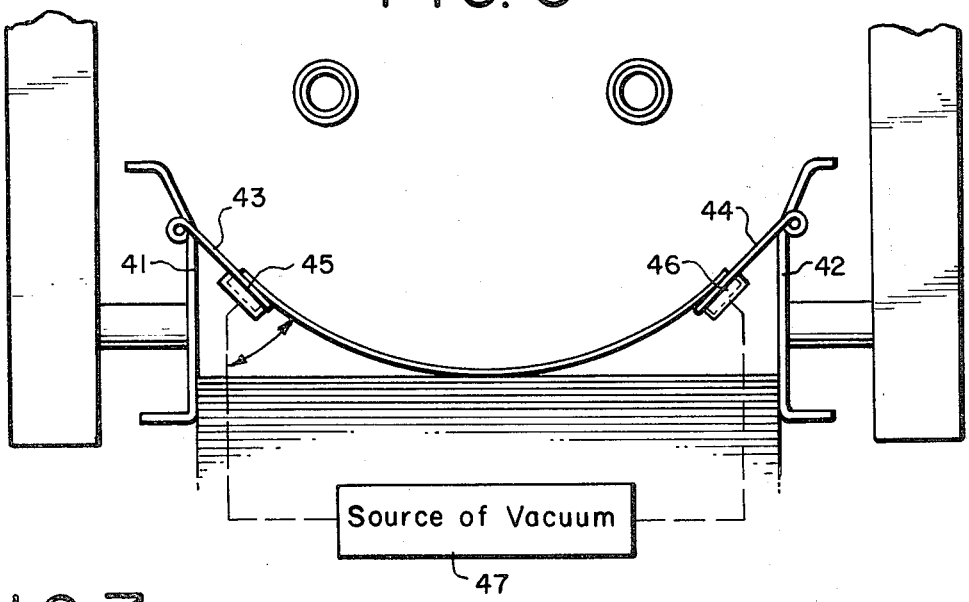
FIG. 7
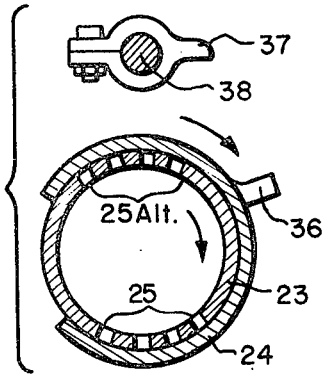
FIG. 8
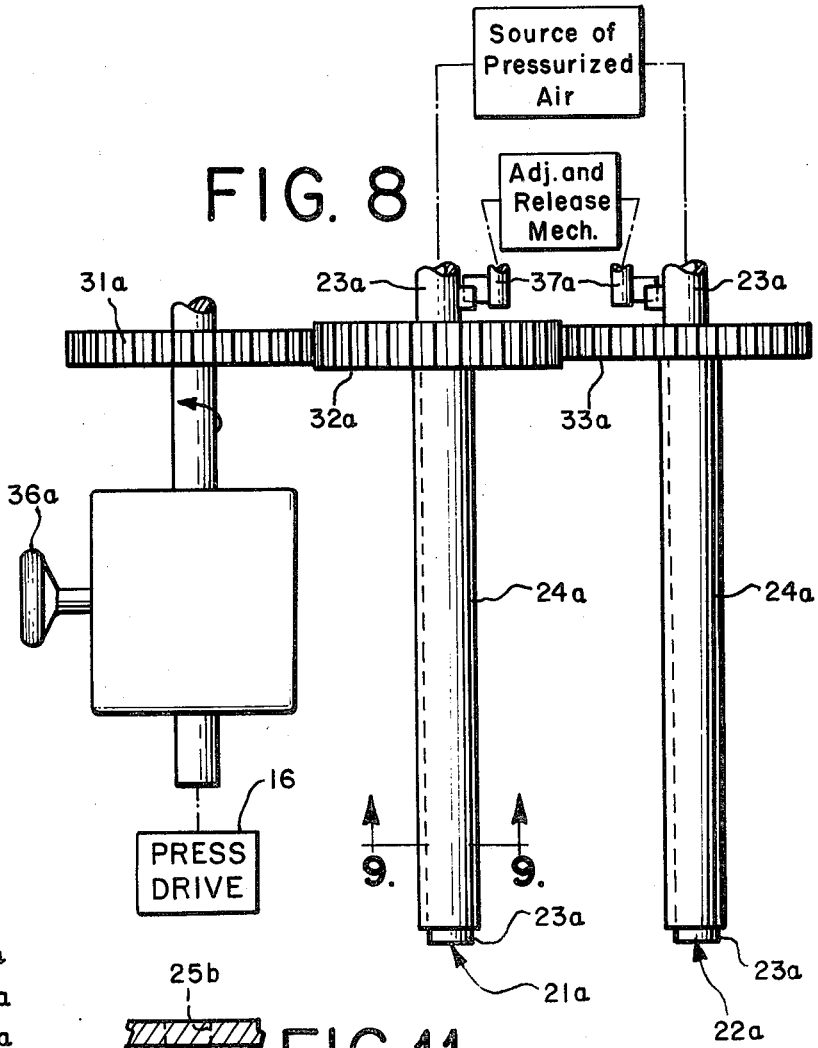
FIG. 9
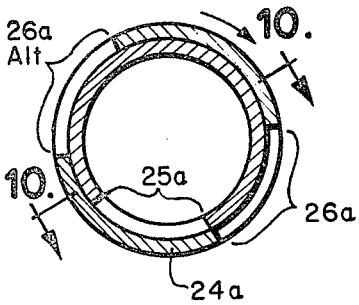
FIG. 10
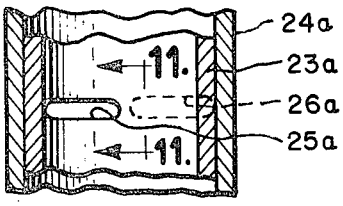
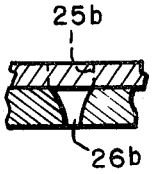
FIG. 11

DEVICE FOR DEPOSITING SHEETS IN SHEET-FED PRINTING PRESS

In a sheet delivery mechanism, particularly for a press of the offset type, printed sheets are transported by a conveyor and released above a delivery pile. Because of the cushion of air which exists under a released sheet the sheet takes considerable time to settle upon the pile and tends to slip sideways during the course of its downward floating action.

Of the prior efforts to more promptly and forcibly seat a released sheet German patent DL-PS 111,870 may be taken as repesentative. In this patent manifolds are provided parallel to the direction of sheet movement, each manifold having a series of angled nozzles. Valves synchronized with the arrival of a sheet admit pressurized air to the manifolds in such sequence that the air applied to the sheet tends to sweep outwardly from the sheet center line. However, the construction has not, in practice, provided a satisfactory solution, the main reason being that each cycle requires a build-up in pressure within the manifolds. In the case of presses having a rapid delivery rate there simply is not time to effect build-up on a sheet-by-sheet basis. Moreover, the device is not capable of optimized ajustment to different sizes of printed product.

It is, accordingly, an object of the present invention to provide means for forcibly seating a released sheet in a delivery mechanism which is highly effective and which is capable of use with presses having high delivery rates. It is a more specific object to provide a device having ported tubes for producing sweeping jets of air and in which the tubes are kept under constant pressure so that there is no inherent limitation in the speed of cycling of the jets.

It is another object to provide a device for forcibly seating a released sheet having convenient means for adjusting the phase of the sweep as well as the sweep path, thereby to optimize the mechanism for different sizes as well as differences in the sheet condition and the sheet material. It is yet another object of the invention to provide a sheet seating arrangement for a delivery mechanism which is relatively simple and inexpensive and which is universal in usage, being readily incorporated into the design of new delivery mechanisms as well as delivery mechanism of existing design already in the field. It is, moreover, an object to provide a device of the above type which is extremely simple to set up and to adjust and which is capable of operating for long periods of time without care or maintenance.

Other objects and advantages of the invention will become apparent upon reading the attached detailed description and upon reference to the drawings in which:

FIG. 1 is an elevational view of a sheet delivery mechanism employing the present invention.

FIG. 2 is an elevational view looking along line 2—2 in FIG. 1.

FIG. 3 is a plan view, in schematic form, of the inventive structure.

FIG. 4 is a cross section of one of the tube assemblies taken along line 4—4 in FIG. 3.

Figure 5A:
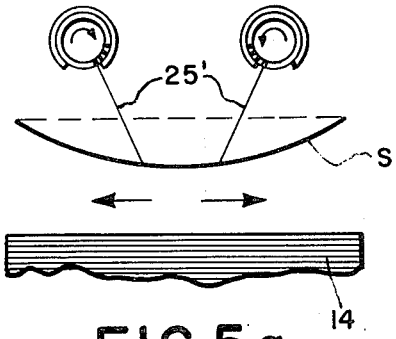

FIGS. 5*a*–5*h* inclusive are a set of stop motion views showing the feeding of a typical sheet.

FIG. 6 shows use of the invention with vacuum type margin raisers.

FIG. 7 is a view similar to FIG. 4 but showing the outer tube in a released sealing position.

FIG. 8 is a schematic plan view similar to FIG. 3 but showing a modified form of the invention.

FIG. 9 is a typical cross section through a tube assembly taken along line 9—9 in FIG. 8.

FIG. 10 is a fragmentary axial section taken along line 10—10 in FIG. 9.

FIG. 11 is a fragment showing optional port shaping taken, for example, along section line 11—11 in FIG. 10.

While the invention has been described in connection with certain embodiments, we do not intend that the invention be limited to the particular embodiments shown but we intend, on the contrary, to cover the various alternative and equivalent constructions included within the spirit and scope of the appended claims.

Referring first to FIGS. 1 and 2 there is shown a delivery mechanism 10 having side frames 11, 12. In the space between is a suspended platform 13 upon which a pile of sheets 14 is established. Sheets are transported from the press (not shown) to the pile 14 via a conveyor 15 which is coupled to the press drive 16. It will be understood that the conveyor 15 is conventional having grippers (not shown) which are triggered to release the sheet above the pile. In a conventional delivery mechanism the released sheet tends to settle slowly upon a cushion of air trapped between the sheet and the pile.

In accordance with the present invention jets of air are directed upon the upper surface of the released sheet from a pair of tube assemblies consisting of inner and outer tubes in snugly telescoped relation containing pressurized air, the tubes within each assembly having registrable arcuately extensive ports with at least one of the tubes of each assembly being rotatable in respectively opposite directions so that the ports in each assembly are progressively moved into and out of arcuate register to produce jets of air which sweep mutually outwardly so that the sheet is forcibly flattened against the pile progressively to the lateral edges of the sheet accompanied by prompt progressive squeezing of the cushion of air from under the lateral edges of the sheet. The sheet seating device 20 shown in FIGS. 3 and 4 consists of a pair of tube assemblies 21, 22. Taking the assembly 21 by way of example it includes an inner tube 23, over which is snugly telescoped an outer tube 24. The inner 23 is constantly connected to a source of pressurized air 25.

In carrying out the invention the tubes have registrable arcuately extensive ports, the port in the inner tube being broken up into an arcuate series of orifices 25 which are, in the present instance, four in number and which may be individually referred to by successive primes. The outer tube is formed with a "free" sector 26 which serves as its arcuately extensive port.

At least one of the tubes in each assembly is rotatable and has a drive connection with the press drive for rotation of the rotatable tubes in unison in respectively opposite directions while the remaining tube in each assembly is fixed. In the embodiment of the invention shown in FIG. 3 the tubes 23 are rotatable through a drive 30 consisting of the spur gears 31, 32, 33. The spur gear 31 has a shaft 34 which is connected to the press drive 16 through a phase changer type transmission 35 having a control 36 for adjusting the phase.

For the purpose of holding the outer tube relatively stationary, but in an adjusted position, the tube is provided with a lug 36 which bears against a stop 37 mounted on a shaft 38 which is positioned by an adjusting and release mechanism 39. While the details of the adjusting and release mechanism are not shown, it will be understood that its effect is, first of all, to adjust the stationary position of the outer tube and, secondly, to move the stop 37 to an out-of-the-way position so that the outer tube may rotate with the inner one, as will be discussed.

Assuming that the outer tube is held stationary in the position shown, the operation as well as the features and advantages of the seating device may be understood in connection with the series of stop motion views set forth in FIGS. 5*a*–5*h*. In these figures the jets of air are designated in accordance with the numeral identification of the aperture, in the inner tube 23, which produces them.

The phase changer 35 is so adjusted that the initial aperture 25' of the port 25 begins to move into the region of the port 26 of the outer tube just as a typical sheet S is released above the pile 14. This produces a pair of air jets 25' which are directed downwardly toward the center of the sheet, bellying the sheet downwardly and initiating outward movement of the air in the cushion as indicated by the arrows. A moment later the jets 25' (FIG. 5*b*) are swung mutually outwardly and the second orifice of each set is uncovered to produce centrally directed jets 25'', with the original jets moving in an outwardly sweeping direction as shown. Shortly thereafter, as indicated in FIG. 5*c* the third orifices are uncovered, resulting in centrally directed jets'''', with the original jets 25', 25'' continuing their outward sweep.

When a condition of full register between the ports 25, 26 is achieved, orifices 25'''' are exposed, with the original jets 25' sweeping all of the way out to the lateral edges of the sheet. As a result of the sequence set forth in FIGS. 5*a*–5*d* the air jets, sweeping outwardly from the sheet center line, cause contact with the pile to be made first at the center of the sheet followed by a flattening of the sheet against the pile progressively to the lateral edges accompanied by a prompt orderly and progressive squeezing of the air cushion from under the sheet. FIGS. 5*e*–*h* show the terminal portion of the jet cycle in which the ports 25, 26 move progressively out of register with one another until the air is completely cut off (FIG. 5*h*) resulting in sheet S being firmly, promptly and accurately seated. The seating occurs so promptly and in such a controlled and consistent fashion that one sheet forms a part of the pile before the succeeding sheet is released. This differs from conventional delivery where, under high speed conditions, several sheets may float simultaneously toward the pile on their respective cushions of air and with great opportunity for side slipping and the curling under of an edge of the sheet. Indeed, because of the forcible expulsion of the cushioning air from the lateral edges there is no inherent limitation in the speed of operation and the present device will, therefore, accommodate the fastest delivery rate of any modern press as well as the delivery rate of any press which may be developed in the future.

It is one of the features of the present invention that it is adaptable to any size or type of sheet. By means of the adjusting and release mechanism 39 the stop 37 may be positioned within a range shown by the dot-dash outline 37' in FIG. 4 thereby adjusting the range of sweep angle. Similarly, by adjusting the phase of the phase changer 35 the beginning of the application of jet air may be controlled relative to the time of arrival of the sheets, making it possible to either slightly anticipate or slightly delay the air, as may be required.

In accordance with one of the aspects of the present invention joggers are provided at the lateral edges of the pile for aligning the edges of the successively received sheets, the joggers being equipped with sheet margin-raisers for inhibiting the fall of the lateral edges thereby to insure escape of the cushioning air. In the present instance the joggers, indicated at 41, 42 in FIG. 6, complete with know individual vibrating mechanisms (not shown) are equipped with inwardly extending margin-raiser arms 43, 44, the ends of the arms being interposed in the path of downward movement of the respective sheet margins as shown. The margin raisers 43, 44 are, as is known, preferably pivotally mounted so as to swing out of the way.

In order to further inhibit the dropping of the margins, the margin raisers have vacuum heads 45, 46 at the ends thereof coupled to a suitable source of vacuum 47. It will be understood that the source of vacuum is capable of adjustment in order to produce just the right amount of drag at the lateral edges of the sheet to assure complete seating before the arrival of the successive sheet.

In carrying out the present invention the adjusting and release mechanism 39 includes provision for moving the stop 37 completely out of the way of the lug 36 on the outer tube as illustrated in FIG. 7. This permits the outer tubes 24 to move with their respective rotating inner tubes 23 in a fixed phase position in which the port orifices 25 are sealed thereby to disable the air jets under standby conditions while maintaining the tubes under pressure.

The invention has been described in connection with a port 25 in the inner tube which is made up of a series of arcuately arranged orifices 25'–25''''. However, it will be understood that the inner tube may be provided with a second, diametrically arranged, port which has been designated at 25 alt. This makes it possible for two successive sheets to be acted upon with but a single revolution of the inner tube 23, the appropriate ratio to accomplish this being achieved in the transmission 35.

While the invention has been described in connection with a pair of tube assemblies in which the inner one of a set of telescoped tubes is rotatable, while the outer one is fixed, it will be understood that the invention is not limited thereto and, if desired, the outer tubes may be rotated, in opposite directions, while the inner tubes are fixed but adjustable. Such an arrangement is shown in FIGS. 8 and 9 in which corresponding elements are indicated by corresponding reference numerals with the addition of subscript "*a*". Here it will be noted that the outer tube 24*a* having ports 26*a* are rotatably coupled to counter rotating gears 32*a*, 33*a*. The inner tubes 23*a*, having arcuately extensive ports 25*a* are held stationarily, but adjustably, in position by stops 37*a*. One further difference in FIGS. 8 and 9 is that the port 25*a*, on the inner tube, instead of being made up of an arcuate series of individual orifices, is made up of a continuous arcuate slit. The open sector of the outer tube is similarly formed of a continuous arcuate slit, as indicated in FIG. 10.

Figure 5E:
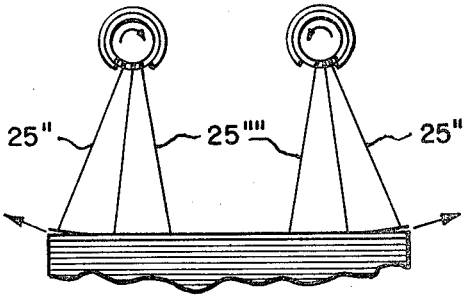
Figure 5B:
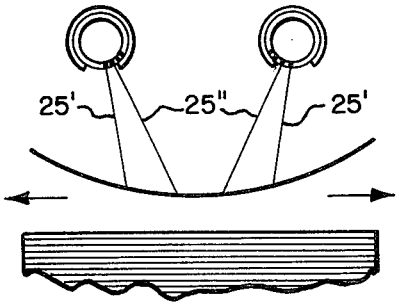
Figure 5F:
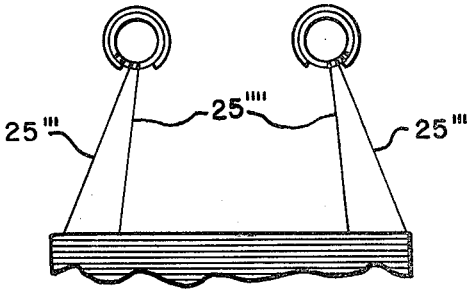
Figure 5C:
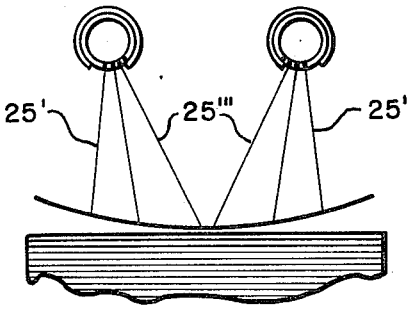
Figure 5G:
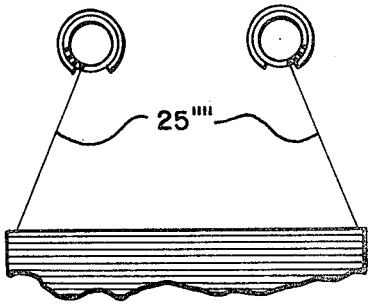
Figure 5D:
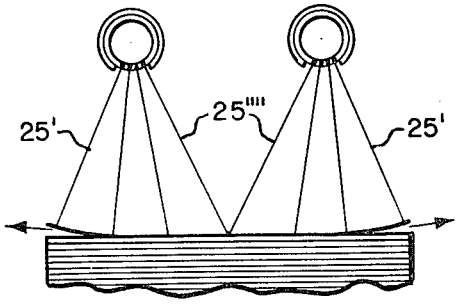
Figure 5H:
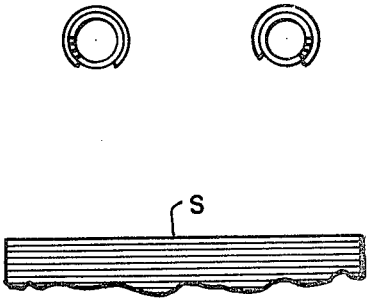

The result, however, is to produce the same fan-like jet pattern as has been illustrated in FIGS. 5*a*–5*h*. Thus when the outer tube is advanced, in the direction of the arrow, slightly beyond the position shown in FIG. 9, the port 26*a* begins to overlap port 25*a* to produce a pair of narrow air jets 25' directed toward the center of the sheet as shown in FIG. 5*a*. A moment later the degree of overlap between the ports has widened to produce a jet defined by the numerals 25'–25", with the outer edges of the jets being progressively swept toward the lateral edges of the sheet until the condition of full register of the ports 25*a*, 26*a*, is achieved as illustrated in FIG. 5*d*. Subsequently, the outer ports 26*a* gradually move out of register with the inner ports to complete the sweeping movement as illustrated in FIGS. 5*e*–5*g*.

Where the ports are formed as slits rather than individual orifices the fan-like nature of the jet may be made more well defined by forming the slit, indicated at 26*b* in FIG. 11, with convergently curved walls to produce a more efficient and precise nozzle action.

The invention has been described in connection with the operation at a typical transverse cross section taken through the tube assemblies and in connection with a single set of registrable ports. It will be understood, however, that the ports illustrated in FIGS. 4 and 9 may be repeated at evenly spaced intervals along the length of the tube assemblies, with the axial spacing being a matter of choice.

The invention has also been described on the assumption that the outer tube 24 of the main embodiment (FIG. 4) is axially continuous. Such tube may, in fact, consist of a number of separate, axially spaced sleeves each having a lug 36 for positioning purposes and each engaging a separate or continuous positioning stop 37. Where such spaced sleeves are used the outer tube may be incomplete, that is to say C-shaped, and any desired means may be used to maintain the individual sections in precise axial positions on the inner tube.

Finally while the invention has been described in connection with a single pair of tube assemblies arranged parallel to one another above the delivery pile symmetrically on opposite sides of the delivery center line, it will be understood that the invention is not necessarily limited to use of two such assemblies and, if desired, a total of four assemblies may be used, with the outer assemblies being phased to complete the mutually outward jet-sweeping action.

What we claim is:

1. In a sheet delivery mechanism for a printing press having a drive and a delivery pile with a conveyor for conveying sheets for release above the delivery pile, means for forcibly seating a released sheet on the pile notwithstanding the cushion of air below it which comprises a pair of tube assemblies arranged parallel to one another above the delivery pile symmetrically on opposite sides of the delivery center line, each tube assembly consisting of inner and outer tubes in snugly telescoped relation, means for constant supplying of air to the inner tubes under pressure, the tubes within each assembly having registrable arcuately extensive ports, at least one of the tubes in each assembly being rotated with respect to the other and having a drive connection with the press drive for rotation in unison in respectively opposite directions, the associated tube being fixed, so that upon release of a sheet above the delivery pile the ports in each assembly are progressively moved into and then out of arcuate register to produce jets of air which sweep mutually outwardly fanwise from the sheet center line so that contact with the pile is made first at the center of the sheet followed by a flattening of the sheet against the pile progressively to the lateral edges accompanied by prompt progressive squeezing of the cushion of air from under the lateral edges of the sheet.

2. In a sheet delivery mechanism for a printing press having a drive and a delivery pile with a conveyor for conveying sheets to a position of release above the pile, means for forcibly seating a sheet on the pile notwithstanding the cushion of air below it which comprises a pair of ported tubes arranged parallel to one another above the delivery pile symmetrically on opposite sides of the delivery center line, means for constant supplying of air to the tubes under pressure, means coupled to the press drive for rotating the tubes in unison in such opposite directions as to produce jets of air which sweep mutually outwardly from the sheet center line so that contact with the pile is made first at the center of the sheet followed by a flattening of the sheet against the pile progressively to the lateral edges thereof accompanied by progressive squeezing of the cushion of air from under the lateral edges of the sheet.

3. In a sheet delivery mechanism for a printing press having a drive and a delivery pile with a conveyor for conveying sheets to a position of release above the pile, means for forcibly seating a sheet on the pile notwithstanding a cushion of air below it which comprises a pair of ported tubes arranged parallel to one another above the delivery pile symmetrically on opposite sides of the delivery center line, means for constant supplying of air to the tubes under pressure, means coupled to the press drive for rotating the tubes in unison in such opposite directions as to produce jets of air which sweep mutually outwardly fanwise from the sheet center line so that contact with the pile is made first at the center of the sheet followed by a flattening of the sheet against the pile progressively to the lateral edges thereof, each ported tube being surrounded by a relatively fixed outer sealing tube having an open sector oriented toward the sheet so that ejection of air occurs only downwardly toward the sheet.

4. In a sheet delivery mechanism for a printing press having a drive and a delivery pile with a conveyor for conveying sheets to a position of release above the delivery pile, means for forcibly seating a sheet on the pile notwithstanding the cushion of air below it which comprises a pair of ported tubes arranged parallel to one another above the delivery pile symmetrically on opposite sides of the delivery center line, each of the tubes having a series of orifices extending arcuately about a portion of its periphery, means for constant supplying of air to the tubes under pressure, means coupled to the press drive for rotating the tubes in opposite directions, each tube being surrounded by a relatively fixed outer sealing tube having an open sector oriented toward the sheet so that the orifices in each ported tube are successively uncovered to produce jets of air which sweep mutually outwardly fanwise from the sheet center line so that contact with the pile is made first at the center of the sheet followed by a flattening of the sheet against the pile progressively to the lateral edges thereof accompanied by progressive squeezing of the cushion of air from under the lateral edges of the sheet.

5. The combination as claimed in claim 1 or claim 2 or claim 3 or claim 4 in which a phase adjusting device is interposed between the press drive and the rotated tubes thereby permitting the beginning of sweep of the jets to be timed with the release of a sheet regardless of the size of the sheet.

6. The combination as claimed in claim 1 or claim 3 or claim 4 in which stops are provided for preventing the fixed tubes from rotating with the rotated tubes, the stops being peripherally adjustable for varying the arc of sweep of the jets.

7. The combination as claimed in claim 1 or claim 3 or claim 4 in which a stop is provided for holding each of the fixed tubes stationary with respect to the cooperating rotated tube, the stops being disengageable so that the fixed tubes are free to rotate with their respective rotated tubes in a phase position in which the ports are sealed thereby to disable the air jets under standby conditions while maintaining the tubes under pressure.

8. The combination as claimed in claim 1 or claim 2 or claim 3 or claim 4 in which joggers are provided at the lateral edges of the pile for aligning the edges of the sheets and in which the joggers have associated sheet margin-raisers for inhibiting the fall of the lateral edges of a released sheet thereby to insure escape of the cushioning air therefrom.

9. The combination as claimed in claim 1 or claim 2 or claim 3 or claim 4 in which joggers are provided on the lateral edges of the pile for aligning the edges of the sheets and in which the joggers have associated sheet margin-raisers for inhibiting the fall of the lateral edges of a released sheet thereby to insure escape of the cushioning air therefrom, the sheet margin-raisers having vacuum heads thereon connected to a source of vacuum for further inhibiting the fall of the lateral edges of the sheet.

* * * * *